US005561276A

United States Patent [19]

Quartarone

[11] Patent Number: 5,561,276

[45] Date of Patent: Oct. 1, 1996

[54] TWO-PHASE-FLOW MUFFLER IN A ROTATING SHAFT

[75] Inventor: James R. Quartarone, Newport, R.I.

[73] Assignee: The United States of America as represented by the Secretary of the Navy, Washington, D.C.

[21] Appl. No.: 550,039

[22] Filed: Oct. 30, 1995

[51] Int. Cl.$^6$ ..... F01N 7/12

[52] U.S. Cl. ..... 181/235; 181/237; 181/272

[58] Field of Search ..... 181/235, 233, 181/227, 228, 237, 269, 272, 273, 275; 440/89; 60/310

[56] References Cited

U.S. PATENT DOCUMENTS

| | | | |
|---|---|---|---|
| 2,360,429 | 10/1944 | Leadbetter | 181/260 |
| 3,448,824 | 6/1969 | Conard, Jr. | 181/260 |
| 4,019,456 | 4/1977 | Harbert | 181/235 |
| 4,601,666 | 6/1986 | Wood, Jr. | 440/89 |
| 5,442,148 | 8/1995 | Hensler | 181/235 |

*Primary Examiner*—Khanh Dang

*Attorney, Agent, or Firm*—Michael J. McGowan; Michael F. Oglo; Prithvi C. Lall

[57] ABSTRACT

A muffler is described for use in connection with an exhaust passage in a elongated shaft rotating about a longitudinal axis. The shaft exhausts exhaust material generated by an internal or external combustion engine, having both a gaseous and a liquid material. The muffler includes a series of partitions situated transverse to the longitudinal axis of the shaft, each partition defining a central aperture to facilitate passage of gaseous material from an input end of the exhaust shaft to an output end of the exhaust shaft, and at least one exterior aperture proximate the sidewall of the exhaust passage to facilitate passage of liquid material from the input end to the output end. The central and exterior passages tend to separate the gaseous and liquid material in the exhaust. The series of partitions define chambers which attenuates the sound energy in the exhaust. A check valve may be provided at the exhaust's output end to reduce back flow of fluid from the exterior of the exhaust back into the exhaust shaft.

13 Claims, 6 Drawing Sheets

TWO-PHASE-FLOW MUFFLER IN A ROTATING SHAFT

STATEMENT OF GOVERNMENT INTEREST

The invention described herein may be manufactured by or for the Government of the United States of America for Governmental purposes without the payment of any royalties thereon or therefor.

BACKGROUND OF THE INVENTION (1) Field of the Invention

The invention relates generally to the field of noise reduction and more particularly to systems for reducing exhaust noise that is generated by powered underwater devices such as torpedoes in which the exhaust consists of a two-phase fluid, namely, liquid and gas.

(2) Description of the Prior Art

Powered underwater devices, such as torpedoes, submarines or the like, generate noise which must be dissipated. In general, the exhaust will consist of a two-phase fluid, namely a liquid and a gas. Currently devices provide a combination drive shaft and exhaust tube that exhausts into the surrounding water without a muffler or other attenuating device, or they provide a very complex muffler design which can be quite bulky and, in some cases, do not fit easily in the relatively small space of a torpedo.

SUMMARY OF THE INVENTION

An object of the invention is to provide a new and improved noise attenuation device (muffler) for use in connection with a powered underwater device such as a torpedo, in which the exhaust consists of a two-phase fluid (liquid and gas) which readily fits into the torpedo's relatively confined space. In particular, the noise attenuation device readily fits into the torpedo's exhaust tube.

In brief summary, the invention provides a muffler in an exhaust shaft rotating about a longitudinal axis. The exhaust shaft exhausts exhaust material generated by an internal or external combustion engine, having both a gaseous and a liquid material. The muffler includes a series of partitions situated transverse to the longitudinal axis of the shaft, each partition defining a central aperture to facilitate passage of gaseous material from an input end of the exhaust shaft to an output end of the exhaust shaft, and at least one exterior aperture proximate the exhaust shaft's sidewall to facilitate passage of liquid material from the input end to the output end. The central and exterior passages in cooperation with the rotational motion of the exhaust shaft tend to separate the gaseous and liquid material in the exhaust. The series of partitions define chambers which attenuates the sound energy in the exhaust. A variety of configurations may be used in connection with the partitions. A check valve may be provided at the exhaust's output end to reduce back flow of fluid from the exterior of the exhaust back into the exhaust shaft.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DESCRIPTION OF THE PREFERRED EMBODIMENT

Figure 1:
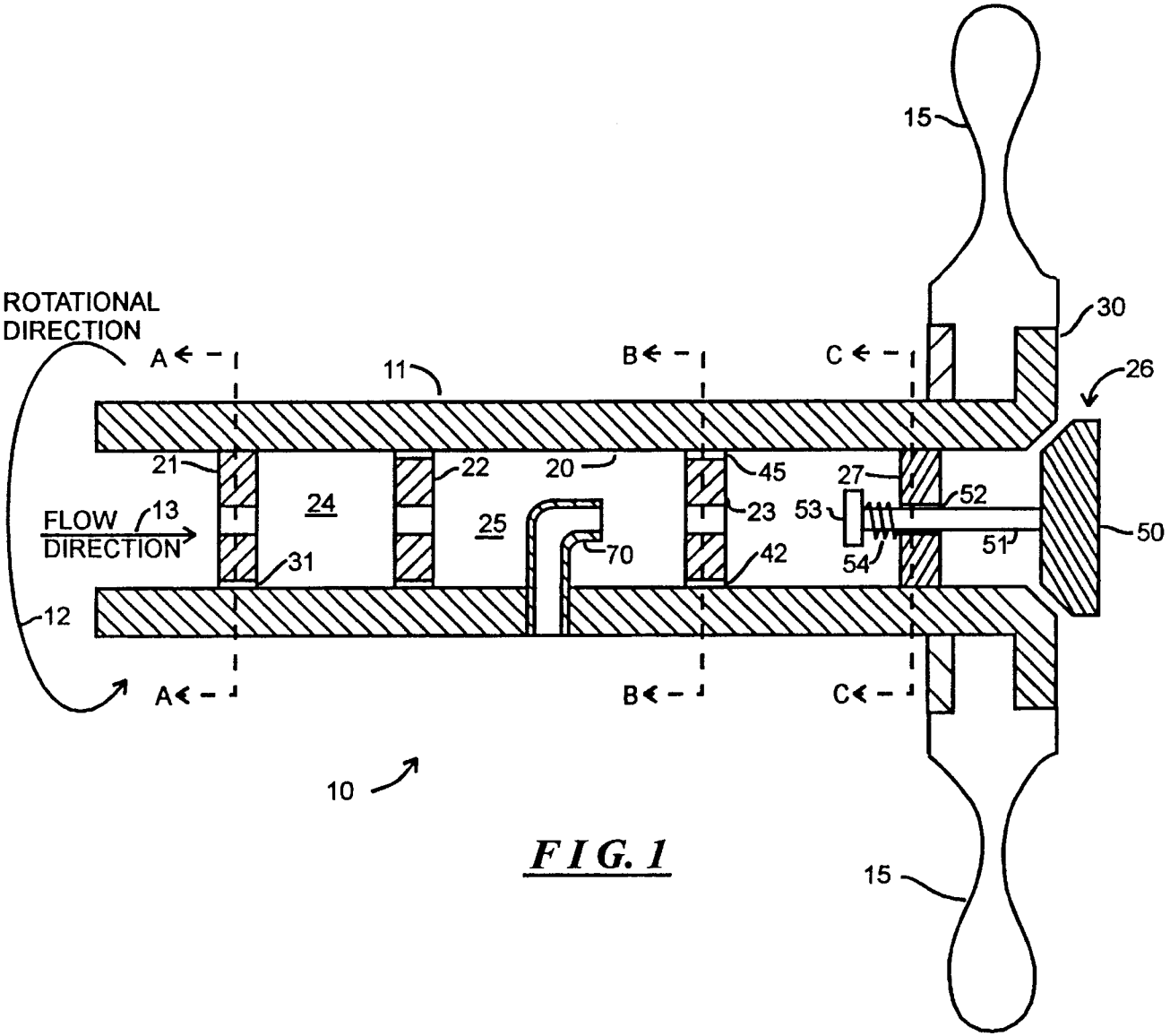
FIG. 1 is a side elevational view, in cross-section, of a two-phase-flow muffler in a rotating shaft, constructed in accordance with the invention.

FIG. 1 is a side elevational view, in cross-section, of a two-phase-flow muffler 10 in a rotating shaft 11, constructed in accordance with the invention. The shaft 11 forms part of the exhaust system for a torpedo or the like which is propelled through a fluid such as seawater, with the exhaust material constituting a two-phase fluid including combustion gases and liquids and frequently coolant fluids. The shaft 11 also forms part of the propulsion system for the torpedo, in particular with a propeller mounted thereon, as illustrated by propeller 15 in FIG. 1. The shaft rotates about its longitudinal axis in a rotational direction indicated by arrow 12, and the exhaust material flows through shaft 11 in a direction indicated by arrow 13.

AS shown in FIG. 1, the muffler 10 comprises the interior cylindrical sidewall 20 of shaft 11 and a series of partitions 21, 22 and 23 which cooperate to form a series of chambers 24 and 25 in the shaft 11. A check valve 26, supported by a support 27, is provided at the output end 30 of the muffler, that is, the end from which the exhaust fluids are expelled from the muffler 10 into the surrounding seawater, to seal the muffler 10 against significant backflow of seawater into the muffler 10.

The partitions 21 through 23, which will be described in greater detail in connection with FIGS. 2 and 3, serve two functions. In one function they serve to assist in separating the two fluid phases into separate liquid and gas phases, with the liquid phase being forced to flow along the sidewall 20. The rotation of the shaft sidewall 20 serves to force the exhaust liquids outwardly toward the sidewall, and the partitions have openings proximate the sidewall 20 to permit liquid flow therethrough at the sidewall. In a second function, the partitions form the chambers 24 and 25 which operate to cause the gas flow to contract and expand in a known manner to cause attenuation of sound.

Figure 2:
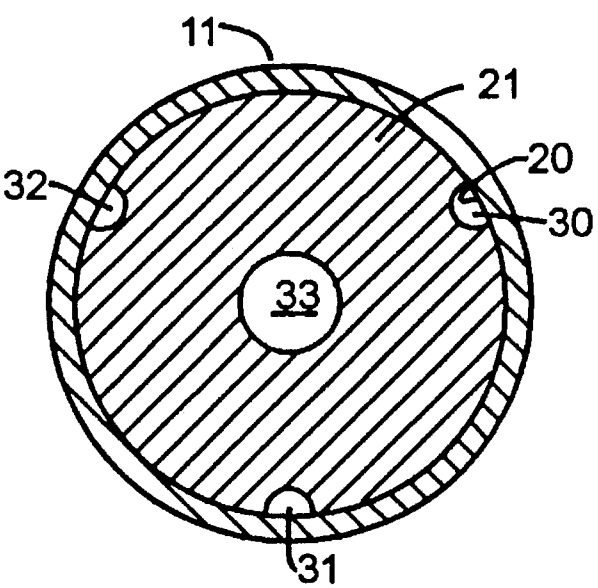

FIG. 2 depicts a cross-section of the muffler 10 taken along dashed line A—A in FIG. 1, specifically detailing the structure of partition 21. With reference to FIG. 2, the partition defines three generally semi-circular outer apertures 30–32 proximate the sidewall 20 of the shaft 11, and a circular central aperture 33. The outer apertures 30–32 are located generally equi-angularly around the shaft 11 and permit fluid proximate the sidewall 20 to flow therethrough. The central aperture 33 permits the flow of exhaust gas and any fluid that may proximate the center to flow into the chamber 24 (FIG. 1). Although a single central aperture 33 is shown in FIG. 2, it will be appreciated that a plurality of apertures may be provided clustered around the center of the partition.

Figure 3:
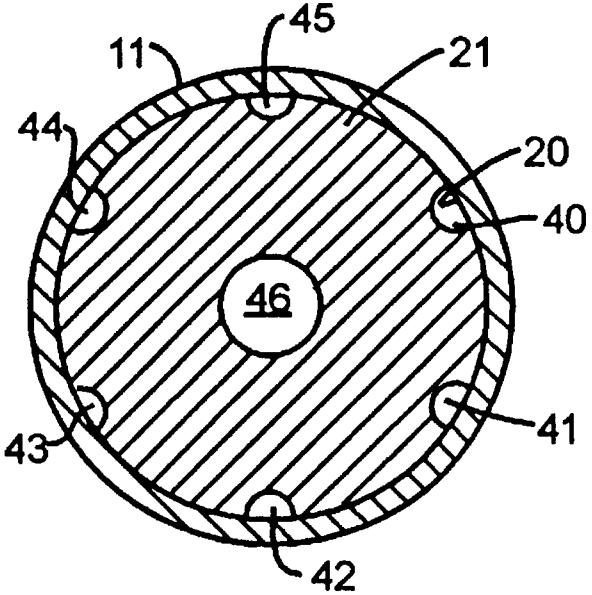

FIG. 3 depicts a cross-section of the muffler 10 taken along dashed line B—B in FIG. 1, specifically detailing the structure of partition 23. (The structure of partition 22 is similar to the structure of partitions 21 and 23 and will not be separately described.) With reference to FIG. 3, the partition defines six generally semi-circular outer apertures 40–45 proximate the sidewall 20 of the shaft 11, and a circular central aperture 46. The outer apertures 40–45 are located generally equip-angularly around the shaft 11 and permit fluid proximate the sidewall 20 to flow therethrough. The central aperture 46 permits the flow of exhaust gas and any fluid that may proximate the center to flow out of the chamber 25 (FIG. 1) (or in the case of the partition 22, to flow from chamber 24 into chamber 25). Although a single central aperture 46 is shown in FIG. 3, it will be appreciated that a plurality of apertures may be provided clustered around the center of the partition.

Returning to FIG. 1, the check valve includes a closure member 50 dimensioned to close off the opening of shaft 11, a shaft 51 which extends through a centrally-located opening 52 in the support 27, and an enlarged head 53. A spring member around the shaft 51 provides a biasing force that urges the head 53 away from the support (toward the left as shown in FIG. 1), which, in turn forces the closure member against the open end of the shaft, thereby closing it off. An O-ring (not shown) may be provided around either the closure member 50 or the open end of shaft 11 to provide a good seal. In addition, a dampening means, such as a dashpot or an elastomeric member around spring 54 may be provided to dampen movement of the shaft 51 and thus of the closure member 50.

Figure 4:
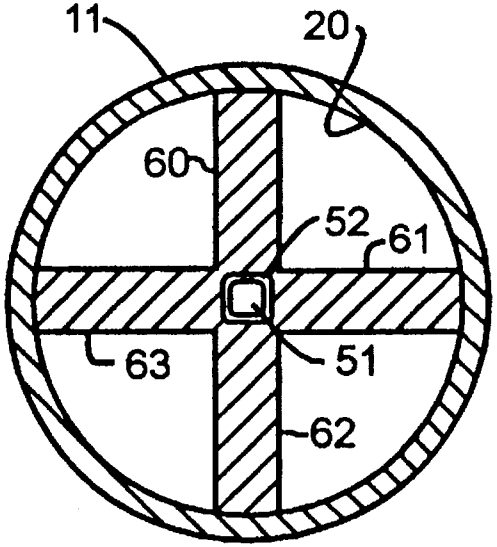
FIGS. 2 through 4 are cross-sectional views taken along lines A—A, B—B and C—C, respectively, in FIG. 1.

FIG. 4 depicts a cross-section of the muffler 10 taken along the dashed line C—C in FIG. 1, in particular depicting the structure of the support 27 for the check valve 26. With reference to FIG. 4, the support 27 includes four legs 60–63, in the form of a cross, defining the central opening 52. The opening 52 and shaft 51 as depicted in FIG. 4 are generally square to prevent rotation of the shaft 51 in the opening 52, thereby assuring cooperative rotation of the check valve 26. It will be appreciated that the support 27 may comprise more or fewer legs than that shown in FIG. 4. In addition, it will be appreciated that the opening 52 and shaft 51 may have other configurations to ensure coupled rotation of the shaft 30 and check valve 26, or they may have configurations which may permit relative rotation.

Returning to FIG. 1, the muffler 10 further includes a vent 70 which provides a passage between the interior of chamber 25 and the exterior of the exhaust drive shaft 11, thereby providing passage to the interior of the afterbody/tailcone section of the vehicle (the torpedo or the like which includes muffler 10) to allow the volume of the vehicle's afterbody/tailcone assembly to operate as a volume resonator, side branch resonator or Helmholtz resonator. In addition, the vent 70 serves to balance pressures between the interior of the vehicle's afterbody/tailcone assembly and the seawater outside thereof. Vent 70 connects the afterbody/tailcone volume to chamber 25 which, in turn, provides a passage to the ocean through apertures 46 and 52 when the check valve 26 is open. This provides a benefit in connection with vehicles for which interior and exterior pressures need to be equalized, since exhaust gases diverted through the vent 70 serve to equalize pressures therebetween. Although the vent 70 is depicted in FIG. 1 as having a neck which is "L-shaped" curved toward the rear (to the right as shown in FIG. 1) it will be appreciated that other configurations may be selected therefor, including flush and angled configurations.

Figure 5:
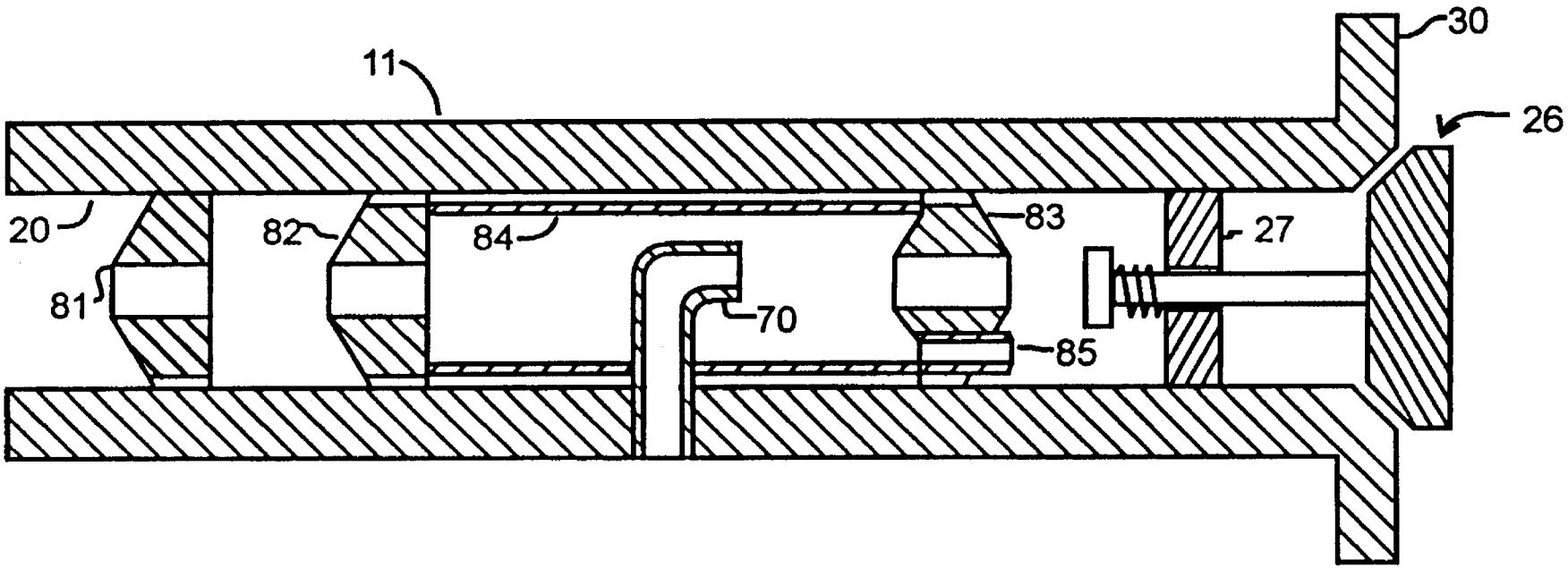
FIG. 5 is a side elevational view, in cross-section, of a second embodiment of the two-phase-flow muffler.

It will be appreciated that numerous modifications may be made to the muffler 10 depicted in FIGS. 1–4, illustrations of some of which will be described in connection with FIGS. 5–9. FIG. 5 depicts muffler 80 comprising a second embodiment of the invention, in which the partitions 81–83 have flared forward edges (toward the left as shown in FIG. 5) which are angled with respect to the direction of flow of exhaust gases (from left to right as shown in FIG. 5) to encourage liquid flow toward the sidewall 20 of the shaft 11. As with partitions 21–23, partitions 81–83 provide apertures proximate the sidewall 20 of shaft 11 to permit fluid flow through the muffler 80. A cylindrical sidewall 84 is positioned interiorly of and coaxial with shaft 11 between partitions 82 and 83. Liquid in the exhaust which makes its way past the partition 82 interiorly of sidewall 84 will be forced onto the sidewall 84, and at least one passageway 85 is provided through partition 83 interiorly of the sidewall 84 to permit liquid flow from sidewall 84 through partition 83.

Figure 6:
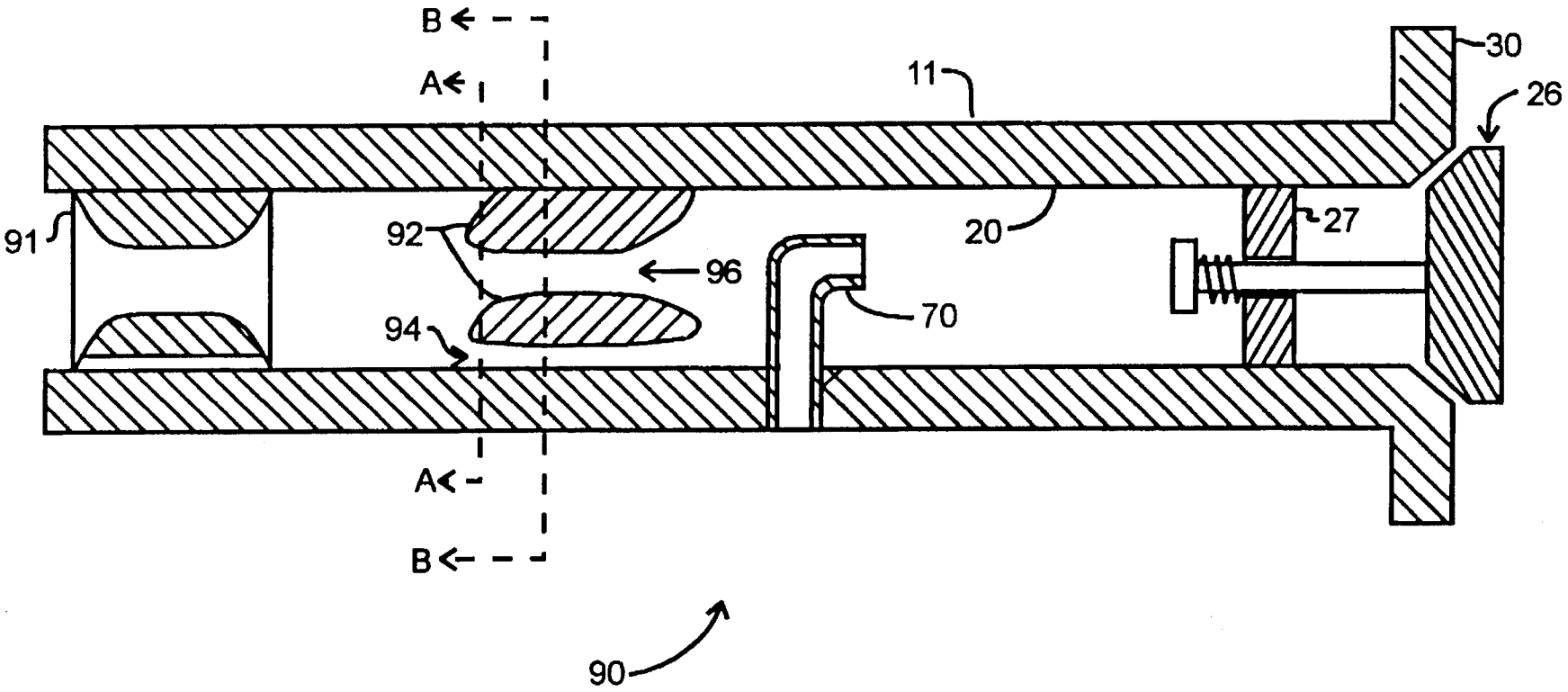
FIG. 6 is a side elevational view, in cross-section, of a third embodiment of the two-phase-flow muffler.
Figure 8:
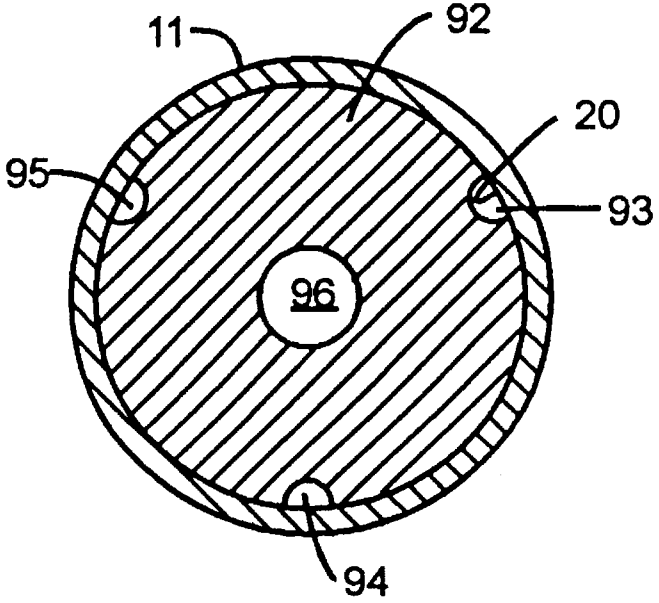
FIGS. 7 and 8 are cross-sectional views taken along lines A—A and B—B, respectively, in FIG. 6.
Figure 7:
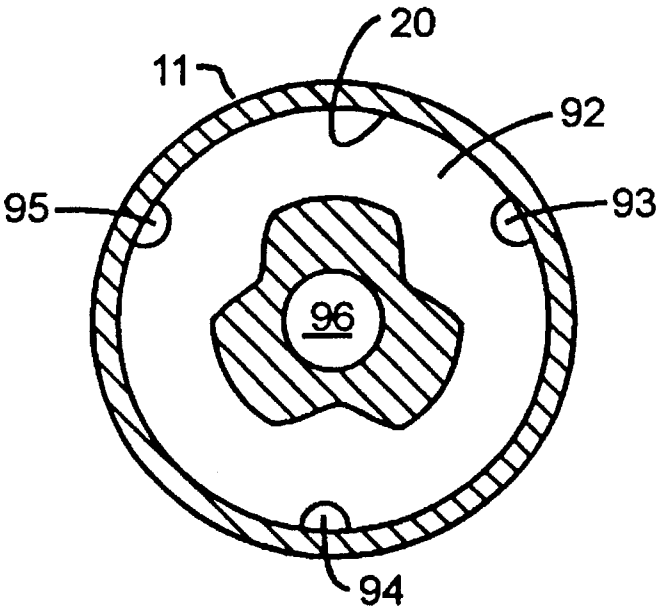

FIG. 6 depicts a muffler 90 comprising a third embodiment of the invention, in which partitions 91 and 92 have smoothly-curved leading and trailing edges (the edges toward the left and right, respectively, as shown in FIG. 6). FIGS. 7 and 8 depict cross-sections of partition 92 taken along dashed lines A—A and B—B in FIG. 6. Both partitions 91 and 92 have apertures positioned equip-angularly proximate sidewall 20 (apertures 93–95 defined by partition 92 are shown in FIGS. 7 and 8) and central apertures such as aperture 96 shown in partition 92. The smooth curves at the leading and trailing edges of partitions 91 and 92 serve to reduce turbulence in the exhaust gases that may develop around the planar surfaces of the leading edges of the partitions in the mufflers 10 and 80 as described in FIGS. 1–5 above, which may assist in fluid flow through muffler 90. It will be appreciated that a third partition (not shown) may also be provided between partition 92 and check valve 26, downstream of the vent 70.

Figure 9:
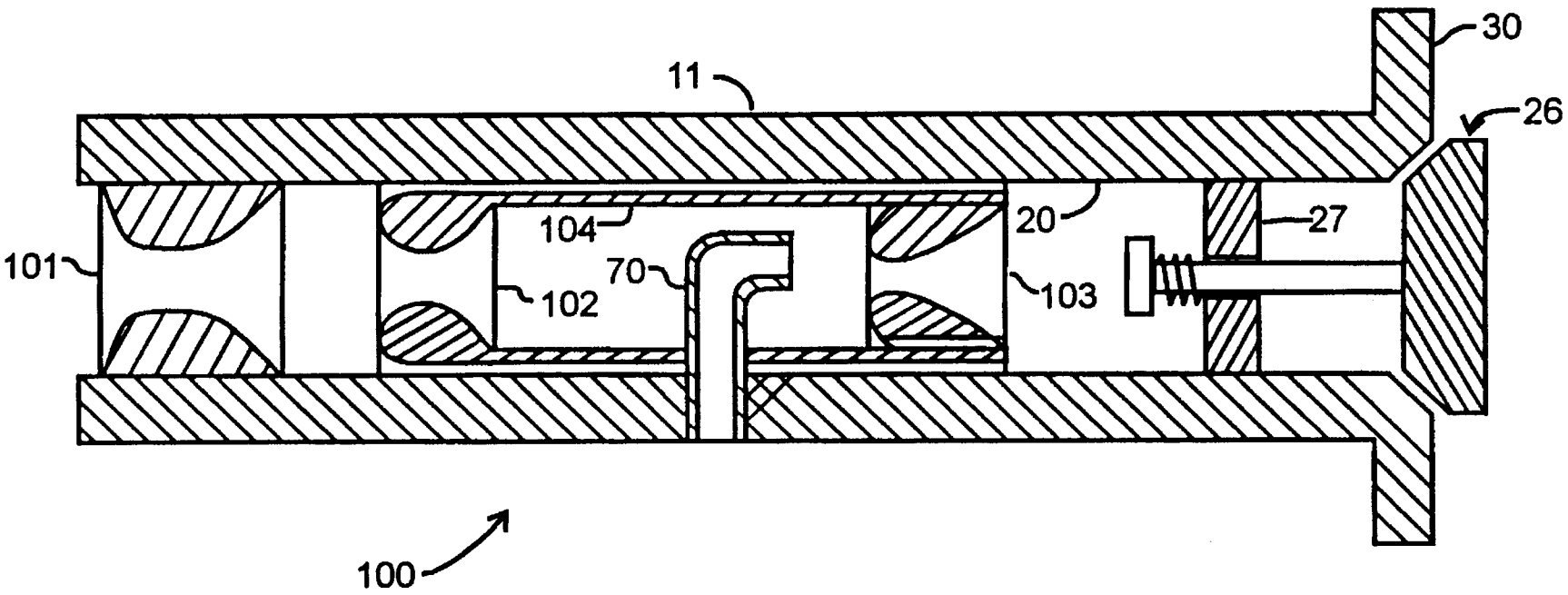
FIG. 9 is a side elevational view, in cross-section, of a fourth embodiment of the two-phase-flow muffler.

FIG. 9 depicts a muffler 100 comprising a fourth embodiment of the invention which combines features of the mufflers 80 (FIG. 5) and 90 (FIG. 6). As with muffler 90, muffler 100 includes partitions 101–103 which have curved leading and trailing edges to reduce turbulence in the gases flowing therethrough. In addition, as with muffler 80, muffler 100 includes a sidewall 104 positioned interiorly of sidewall 20 between partitions 102 and 103 which helps to separate the liquid and gas phases of the exhaust fluid.

Numerous other modifications may be made to the inventive muffler(s) as described herein. For example, for vehicles in which interior/exterior pressure equalization is not necessary, the vent 70 may be omitted, and for vehicles in which backflow will not cause a problem the check value 26 and its support 27 may be omitted. In addition, while the shaft 11 has been described as having a circular cross-section, it will be appreciated that the shaft may have a cross-section which is elliptical, square or other shape, with modifications of the partitions which will be apparent to those skilled in the art.

Furthermore while mufflers have been described having two or three partitions (defining one or two chambers), it will be appreciated that more or fewer partitions and chambers may be provided. The partitions are positioned to define chambers which operate as impedance to sound energy in the exhaust gases, and it will be appreciated that the positions of the partitions along the shaft 11 will depend on the frequency and energy levels of the sound and the width of the shaft 11. The partitions may also be configured with the central aperture(s) angled to force exhaust flow toward the sidewall 20, instead of directing it axially.

In addition, it will be appreciated that sound-absorbing or damping materials, may be used to coat some or all of the interior surface 20 of the shaft 11 and the surfaces of the partitions and the vent 70.

The preceding description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed is:

1. A muffler for use in connection with a central exhaust passage in an elongated shaft rotating about a longitudinal axis, the exhaust shaft having a sidewall, the exhaust shaft exhausting exhaust material having both a gaseous and a liquid material, the muffler comprising:

a series of partitions situated transverse to the longitudinal axis of the shaft, each partition defining a central aperture to facilitate passage of gaseous material from an input end of the exhaust shaft to an output end of the exhaust shaft; and at least one exterior aperture proximate the exhaust shaft's sidewall to facilitate passage of liquid material from the input end to the output end thereby to separate the gaseous and liquid material.

2. A muffler as defined in claim 1 further including a check valve proximate the output end to inhibit flow of fluid from exterior of the shaft to the interior of the shaft.

3. A muffler as defined in claim 2 in which the check valve includes:

a valve closure member, an interior support mounted in the shaft for supporting the valve closure member; and closure biasing means for cooperating with the valve closure member and the interior support for biasing the valve closure member in a closed condition, with the gaseous exhaust material generating internal pressures which enable the check valve to open.

4. A muffler as defined in claim 3 in which the check valve further includes dampening means which cooperate with the closure biasing means to dampen movement of the valve closure member.

5. A muffler as defined in claim 1 in which at least one partition has a planar leading edge.

6. A muffler as defined in claim 1 in which at least one partition has a flared leading edge which urges liquid material in the exhaust material which impinges on the partition toward the shaft sidewall.

7. A muffler as defined in claim 1 in which at least one partition has a smooth curved leading edge to reduce turbulence in gaseous material in the exhaust material flowing through the partition's central aperture.

8. A muffler as defined in claim 1 in which at least one partition has a smooth curved trailing edge to reduce turbulence in gaseous material in the exhaust material flowing through the partition's central aperture.

9. A muffler as defined in claim 1 further comprising an interior sidewall situated interiorly of the shaft sidewall between a two successive partitions in the shaft.

10. A muffler as defined in claim 9 in which a downstream one of the successive partitions further include an aperture proximate the interior sidewall to enable liquid material which settles on the interior sidewall to flow therethrough.

11. A muffler as defined in claim 1 further including a vent formed in the shaft sidewall between successive partitions, the vent being configured with the partitions to operate as a volume resonator.

12. A muffler as defined in claim 1 further including a vent formed in the shaft sidewall between successive partitions, the vent being configured with the partitions to operate as a side branch resonator.

13. A muffler as defined in claim 1 in which the shaft has affixed thereto a propeller and serves to rotate the propeller to propel a vehicle through a water environment.

* * * * *